US006887186B2

(12) United States Patent
Bambanian

(10) Patent No.: US 6,887,186 B2
(45) Date of Patent: May 3, 2005

(54) WATER AEROBIC EXERCISE FLOAT

(76) Inventor: Melina Bambanian, 9815 Creemore Dr., Tujunga, CA (US) 91042

( * ) Notice: Subject to any disclaimer, the term of this patent is extended or adjusted under 35 U.S.C. 154(b) by 0 days.

(21) Appl. No.: 10/643,053

(22) Filed: Aug. 16, 2003

(65) Prior Publication Data

US 2005/0037900 A1 Feb. 17, 2005

(51) Int. Cl.[7] ..... A63B 3/00
(52) U.S. Cl. ..... 482/55; D21/803; 441/129
(58) Field of Search ..... 482/111, 55; 472/13; D21/803–806; 441/129–132

(56) References Cited

U.S. PATENT DOCUMENTS 5,000,710 A * 3/1991 Bedortha et al. ..... 441/129
D341,406 S * 11/1993 Scheurer ..... D21/805
5,472,391 A * 12/1995 Weissbuch ..... 482/55
D396,076 S * 7/1998 Muasher ..... D21/662
5,820,530 A * 10/1998 Kallassy ..... 482/111
D420,716 S * 2/2000 Kiefer et al. ..... D21/805
D422,331 S * 4/2000 Ponce de Leon ..... D21/803
6,071,161 A * 6/2000 Weissbuch ..... 441/106
6,231,832 B1 * 5/2001 Srivastava et al. ..... 424/1.65
D489,426 S * 5/2004 Oakley ..... D21/803

* cited by examiner

*Primary Examiner*—Justine R. Yu
*Assistant Examiner*—Tam Nguyen
(74) *Attorney, Agent, or Firm*—Law Offices of Clement Cheng

(57) ABSTRACT

A flotation device for water aerobics comprising a single piece of foam shaped to form a main central member having positive buoyancy and a pair of float arms having positive buoyancy. Each float arm terminates in a handle, and the foam arms of the device attached to the main central member may bend flexibly according to the motion of a user's arms.

9 Claims, 2 Drawing Sheets

WATER AEROBIC EXERCISE FLOAT

DISCUSSION OF RELATED ART

Water aerobic exercises have increased in popularity because water aerobic exercises increase heart rate and oxygen intake without the shock of running on a hard surface. A variety of flotation devices in the past allowed a person to float without substantial effort.

A variety of devices allowed swimming without flotation worry. Dating back to 1923, Vilbiss (U.S. Pat. No. 1,487,923) introduced an early floating device allowing users to float on a U-shaped inflatable tube rounding the user's neck. Although the tube material in Vilbiss was rubber, the idea of using floating materials to support swimmers on water has been enhanced since then. Beasley (U.S. Pat. No. 4,768,774) shows an aquatic exercise device for use in a swimming pool or the like having hand-gripping means.

Later flotation devices allowed users a comfortable lounging position in the water. Clifford (U.S. Pat. No. 5,628,658) in 1997 forms a round form floatation piece a seat-like tube device for both recreational and exercise purposes. The "round form floatation device", well-known as the "noodle" nowadays, can be inserted into a sleeve to form the seat-like shape for users to rest in the water. Based on the same idea, Saltel (U.S. Pat. No. 6,276,979), in 2001, introduced a floating mesh seat allowing the user to sit on the mesh, which was placed and tied in the center area of a U-shaped noodle. The user may again sit and float on the water surface while resting his or her back onto the closed portion of the U. In 1999, Hartman (U.S. Pat. No. 5,897,409) advanced the floating seat idea to floating lounger with a rotating headrest. The floatable lounger was assembled by more than one floatation piece and provided better buoyancy than any other inventions before.

Some devices incorporated playful toys into their design. In 1999, Sanso (U.S. Pat. No. 5,971,823) shows a pair of hand-held tools on the end of an elongated flotation device, the noodle, with a trigger to squirt water. In 2002, Sanso (U.S. Pat. No. 6,482,058) the device discloses a pair of paddles over the end portion of the noodle. Those paddles may be used to propel a floatation device user through the water in which the device is afloat.

While the existing floating devices have numerous nifty features, they are not specially adapted for the popular water aerobics exercises many users engage in.

BRIEF DESCRIPTION OF THE DRAWINGS

Figure one is a drawing of a person using the device.

Figure two is a top view of the device.

Figure 1:
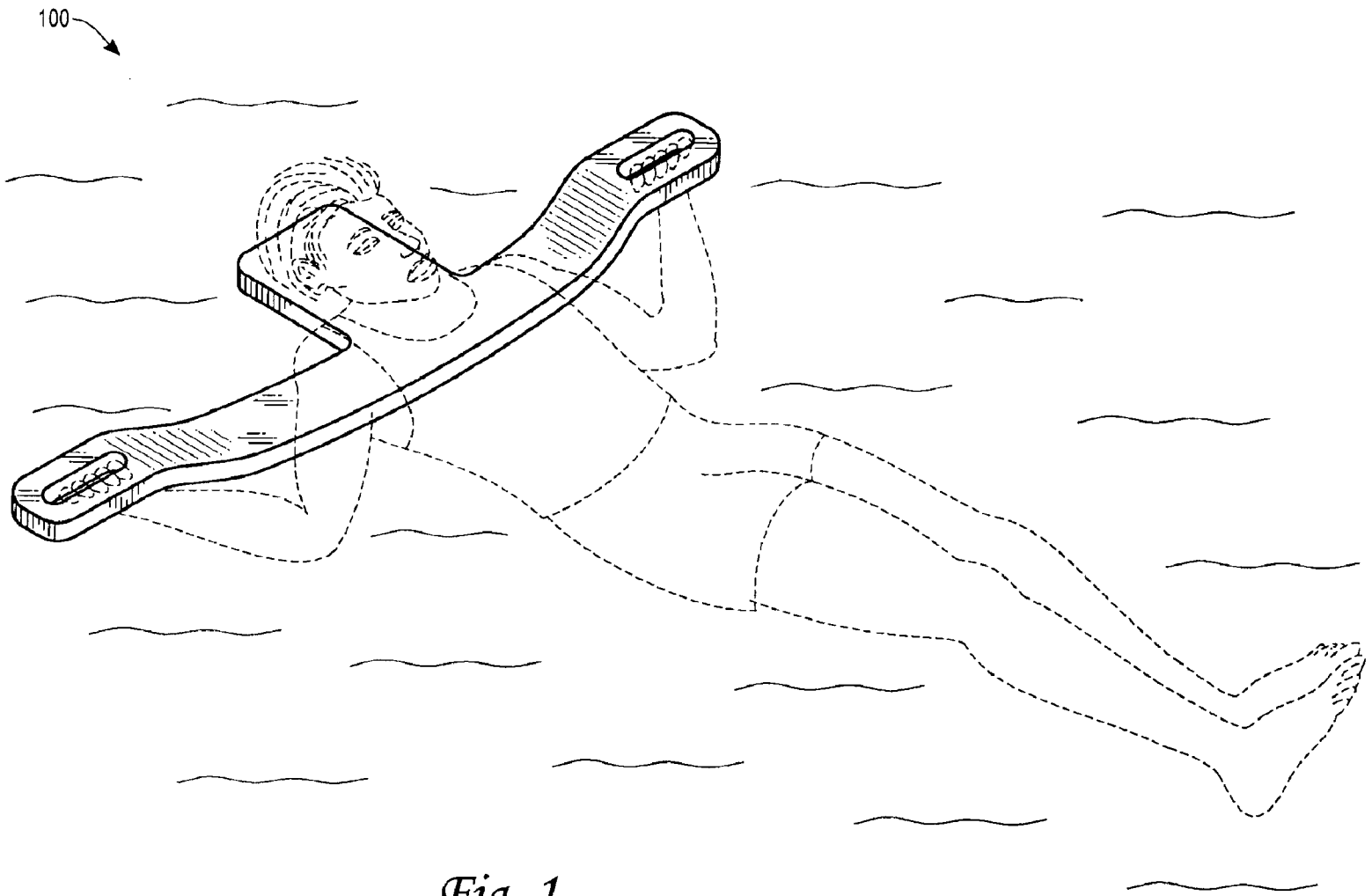
Figure 2:
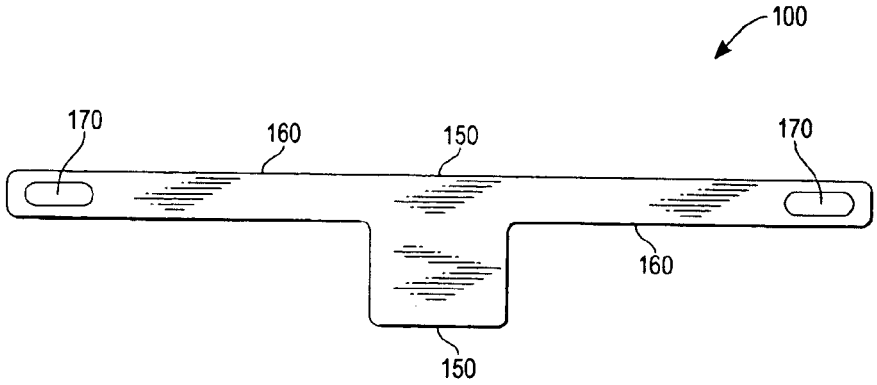
Figure 3:
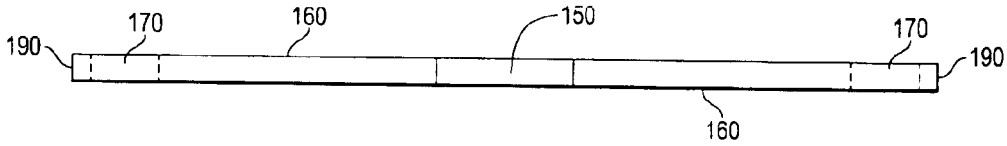
Figure 4:
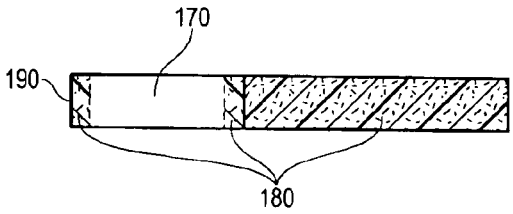

Figure three is a front view of the device.

Figure four is a cut away view of the device.

DETAILED DESCRIPTION OF THE PREFERRED EMBODIMENT

The device 100 is made of a single piece of foam 180 having positive buoyancy. The single piece may be formed from multiple joined pieces of foam. The foam pieces could be joined by heat or by sonic welding. The device includes a foam positive buoyancy main section 150 that has substantially more buoyancy than an attached surround ing pair of float arms 160 extending to the left and the right of the main section. A user may grasp the end of each arm by a handle 170 formed in the end of each arm 190. The handle

170 is formed of buoyant foam material 180 also and may be formed as a hollowed cutout of the foam.

When a user grasps each arm and places the main central member behind the head, the main central member 150 is used as a headrest. The buoyancy of the arms stabilizes a user in the water. The foam arms 160 of the device attached to the main central member 150 may bend flexibly according to the motion of a user's arms. The end of the float arms 190 may move relative to the headrest member 150. The head rest portion provides a user greater buoyancy in the center of the device.

The handles 170 are formed in the foam by providing a slot for a person to reach through. A left slot and a right slot may be formed to create a pair of handles attached on the opposing ends of the opposing arms. The pool float exercise device allows a person to shift buoyancy during exercises using a central headrest member 150 and a pair of buoyant arms 160. The pool float has a central headrest member 150.

The arm members 160 are flexible and connect to each other via the main central member 150. A user holding the arm members by the handles 170 and resting her head on the central member 150 may perform a variety of water aerobic exercises.

FIG. 1, a user may lay on his back and kick his legs through the water. In this case, a user holds each handle 170 along the sides of his body and rests his head on the headrest 150. Beginning swimmers may use this configuration for learning the legwork necessary for a backstroke. A user may also learn the leg movements and body movements for the butterfly by the same position. In both cases, the headrest 150 supports the torso and the arm members 160 support a user's arms so that a user may concentrate on leg movement while the upper torso is stabilized. Similar isolation exercises may be conceived of the same spirit.

A user may then stand vertically in the water holding the device by the handles 170 and having a head supported by the headrest 150. Here, a common water exercise is a bicycling motion made with the legs of an exercise participant. The bicycling motion can be completed by the participant where the participant grasps each arm and is resting on the headrest central member 150. The headrest central member 150 provides buoyancy and holds the participant in a standing position while floating in the water. The participant may then perform a bicycling motion or kick legs according to the rhythm provided by an instructor.

A participant user may also grasp both handles 170 and twist the torso. In this case, the central headrest member 150 maintains the user in a vertical position. The user exercises abdominal muscles without becoming unstable in the water. A user may pull the handles 170 below the surface of the water for exercising the torso using the positive buoyancy resistance in the foam arms 160.

Figure two shows the device 100 from a top view including a pair of handles 170 at opposite ends 190. Figure three shows the same device 100 from a frontal view. Figure four shows a cutaway version of the same device 100 in figure three. Although the drawings show a basically rectangular flotation device 100, the device may be styled to include a circular, or oval design for the headrest 150 and more circular design for the ends of the arm members 190.

The expanded foam material 180 is flexible and remains flexible in water. The material 180 has positive buoyancy due to the air trapped within the material. The material can be injection molded where a mold of the final shape of the object is injected with expanded foam. The foam when cooled retains its shape and is flexible such that a user may bend or flex the material.

The foregoing describes the preferred embodiments of the invention. Modifications may be made without departing from the spirit and scope of the invention as set forth in the following claims.

Call out List of Elements
Flotation Device 100
Headrest Member 150
Float Arms 160
Handles 170
Foam Material 180
End of Float Arms 190

What is claimed is:

1. A flotation device for water aerobics comprising a single piece of foam shaped to form a main central member having positive buoyancy a pair of float arms that extend from the main central member having positive buoyancy, wherein each float arm terminates in a slot forming handle shaped to receive a hand, wherein the foam arms of the device attached to the main central member may bend flexibly according to a user's arm's motions and the slot forming handles have an elongated length parallel to the left and right arm members.

2. The flotation device of claim 1, wherein the main central member has more buoyancy than the attached pair of float arms.

3. The flotation device of claim 1, wherein the handles are formed of a slot through the arm member of the buoyant foam material.

4. The flotation device of claim 1, wherein the arm members are flexible and connect to each other via the main central member, wherein a user holding the arm members by the handles and resting her head on the central member may perform a variety of water aerobic exercises.

5. A flotation device for water exercises comprising a main central member forming a headrest; a left arm member protruding to the left from the main central member; and a right arm member protruding to the right from the main central member, the main central member formed to support a user's neck and head, wherein the left and right arm members form a handle, having a slot with an elongated length that is parallel to the arm members and at their ends allowing a user to grasp the left and right ends of the left and right arm members.

6. The flotation device of claim 5, wherein the main central member has more buoyancy than the attached pair of float arms.

7. The flotation device of claim 5, wherein the handles are formed of buoyant foam material.

8. The flotation device of claim 5, wherein the arm members are flexible and connect to each other via the main central member, wherein a user holding the arm members by the handles and resting her head on the central member may perform a variety of water aerobic exercises.

9. A hand held flotation device for water exercises comprising a main central member forming a headrest shaped to support a person's head; a left arm member protruding to the left from the main central member; and a right arm member protruding to the right from the main central member, the main central member formed to support a user's neck and head, wherein the left and right arm members each have slot forming handles shaped to receive a hand at their ends allowing a user to grasp the left and right ends of the left and right arm members and each slot has an elongated length parallel to the left and right arm members.

* * * * *